US007489185B2

(12) United States Patent
Lee

(10) Patent No.: US 7,489,185 B2
(45) Date of Patent: Feb. 10, 2009

(54) VOLTAGE CONVERTING CIRCUIT STRUCTURE

(75) Inventor: Chao-Cheng Lee, Hsin-Chu (TW)

(73) Assignee: Realtek Semiconductor Corp., HsinChu (TW)

( * ) Notice: Subject to any disclaimer, the term of this patent is extended or adjusted under 35 U.S.C. 154(b) by 0 days.

(21) Appl. No.: 11/946,879

(22) Filed: Nov. 29, 2007

(65) Prior Publication Data

US 2008/0068071 A1 Mar. 20, 2008

Related U.S. Application Data

(62) Division of application No. 11/306,300, filed on Dec. 22, 2005, now abandoned.

(60) Provisional application No. 60/595,905, filed on Aug. 16, 2005.

(51) Int. Cl.
*G05F 1/10* (2006.01)

(52) U.S. Cl. ..... 327/540

(58) Field of Classification Search ..... 307/15, 307/36; 327/540, 541
See application file for complete search history.

(56) References Cited

U.S. PATENT DOCUMENTS

| | | | | |
|---|---|---|---|---|
| 4,013,901 | A * | 3/1977 | Williams | 326/79 |
| 4,229,668 | A * | 10/1980 | Ebihara et al. | 327/576 |
| 5,198,699 | A | 3/1993 | Hashimoto | |
| 5,220,205 | A | 6/1993 | Shigehara | |
| 5,568,085 | A | 10/1996 | Eitan | |
| 5,877,928 | A * | 3/1999 | Makino | 361/91.5 |
| 5,909,128 | A * | 6/1999 | Maeda | 326/116 |
| 5,936,455 | A * | 8/1999 | Kobayashi et al. | 327/437 |
| 6,424,219 | B1 * | 7/2002 | Kato | 330/255 |
| 6,552,581 | B1 * | 4/2003 | Gabara | 327/108 |
| 6,822,296 | B2 * | 11/2004 | Wang | 257/355 |
| 7,018,886 | B2 * | 3/2006 | Chi | 438/221 |
| 7,230,806 | B2 * | 6/2007 | Poon et al. | 361/56 |
| 7,283,342 | B1 * | 10/2007 | Ker et al. | 361/56 |

* cited by examiner

*Primary Examiner*—Jeffrey S Zweizig
(74) *Attorney, Agent, or Firm*—Winston Hsu

(57) ABSTRACT

A voltage converting circuit is able to convert an input voltage generated by a system to a voltage capable of being utilized by a chip, avoids the defects of conventional switching regulators and linear regulators, and achieves voltage regulation with extremely high power efficiency and without off-chip components. The voltage converting circuit is adapted in systems with a plurality of similar or identical circuits.

20 Claims, 5 Drawing Sheets

VOLTAGE CONVERTING CIRCUIT STRUCTURE

CROSS REFERENCE TO RELATED APPLICATIONS

This application is a division of now abandoned application Ser. No. 11/306,300, filed Dec. 22, 2005, from which the specification and drawings are carried forward without amendment. Both applications claim the benefit of U.S. Provisional Application No. 60/595,905, which was filed on Aug. 16, 2005 and entitled "High Power Efficiency Circuit and Design".

BACKGROUND OF THE INVENTION

1. Field of the Invention

The present invention relates to a voltage converting circuit, and more particularly, to a voltage converting circuit capable of improving power efficiency.

2. Description of the Prior Art

Generally speaking, supply voltages utilized by integrated circuit chips come from systems. For examples, supply voltages for network chips, wireless communication chips, or image processing chips disposed in desktop or laptop computers are provided by motherboards. However in general case, input voltages generated by systems are too high to be used directly as supply voltages in IC chips unless certain voltage converting circuits first convert input voltages into lower voltage level that suits IC's use.

Typical voltage converting circuits include switching regulators and linear regulators.

Switching regulators achieve high power efficiency. For example, if a 3V input voltage is to be converted into a 1.5V supply voltage, the switching regulator achieves high power efficiency, even close to 90%, but an off-chip inductor or capacitor is required. Off-chip components such as inductors or capacitors are not only expensive but also large in volume. Besides, the switching regulator causes ripple effect at the voltage output, and results in unstable output voltages.

Linear regulators utilize an off-chip bipolar junction transistor (BJT) to replace the off-chip inductor or capacitor. The BJT is much lower in price and causes few ripples. However, linear regulators have low power efficiency. For example, if the 3V input voltage is converted into the 1.5V supply voltage, the best power efficiency that linear regulators can achieve is only 50%.

SUMMARY OF THE INVENTION

It is therefore an objective of the present invention to provide a voltage converting circuit and method for improving power efficiency of voltage conversion. Thus voltage conversion is achieved with extremely high power efficiency without off-chip components.

According to embodiments of the present invention, a voltage converting circuit is disclosed. The disclosed voltage converting circuit includes a first circuit, a second circuit, a first driving unit. A first current flows through the first circuit and a first voltage drop spans the first circuit. The second circuit is coupled to the first circuit, wherein a second current flows through the second circuit and a second voltage drop spans the second circuit. And, the first driving unit is coupled to the connecting point between the first circuit and the second circuit.

According to embodiments of the present invention, a voltage converting apparatus is disclosed. The disclosed voltage converting apparatus includes a reference voltage generation unit and a voltage converting unit. The reference voltage generation unit is for generating a reference voltage. The voltage converting unit includes a first circuit and a second circuit, wherein the first circuit is coupled to the second circuit, the first circuit is similar to the second circuit, and the reference voltage generation unit is coupled to the voltage converting unit.

According to embodiments of the present invention, a circuit system is disclosed. The circuit system includes N sub-circuits and N−1 voltage generation circuits. The N sub-circuits are for respectively providing for at least part of the functions of the circuit system. Each of the N−1 voltage generation circuits generates a voltage level respectively. The N sub-circuits are coupled in cascode between a high voltage level and a low voltage level of a system power supply voltage. A local power supply voltage of a first sub-circuit of the N sub-circuits is composed of the high voltage level of the system power supply voltage and the voltage level generated by a first voltage generation circuit of the N−1 voltage generation circuits. A local power supply voltage of a Nth sub-circuit of the N sub-circuits is composed of the voltage level generated by a (N−1)th voltage generation circuit of the N−1 voltage generation circuits and the low voltage level of the system power supply voltage. And a local power supply voltage of a nth sub-circuit of the rest of the sub-circuits is composed of the voltage level generated by a (n−1)th voltage generation circuit of the N−1 voltage generation circuits and the voltage level generated by a nth voltage generation circuit of the N−1 voltage generation circuits.

According to embodiments of the present invention, a circuit system is disclosed. The circuit system includes a system power supply voltage generator, a voltage generation circuit, a first sub-circuit, and a second sub-circuit. The system power supply voltage generator is for generating a high voltage level and a low voltage level of a system power supply voltage. The voltage generation circuit is for generating a voltage level. The first sub-circuit is coupled to the system power supply voltage generator and the voltage generation circuit for providing a first function of the circuit system. The second sub-circuit is coupled to the system power supply voltage generator and the voltage generation circuit for providing a second function of the circuit system. A local power supply voltage of the first sub-circuit is provided by the high voltage level and the voltage level generated by the voltage generation circuit, and a local power supply voltage of the second sub-circuit is provided by the voltage level generated by the voltage generation circuit and the low voltage level.

According to embodiments of the present invention, a circuit system is disclosed. The circuit system includes a system power supply voltage generator, a first voltage generation circuit, a second voltage generation circuit, a first sub-circuit, a second sub-circuit, and a third sub-circuit. The system power supply voltage generator is for generating a high voltage level and a low voltage level of a system power supply voltage. The first voltage generation circuit is for generating a first voltage level. The second voltage generation circuit is for generating a second voltage level. The first sub-circuit is coupled to the system power supply voltage generator and the first voltage generation circuit for proving a first function of the circuit system. The second sub-circuit is coupled to the first voltage generation circuit and the second voltage generation circuit for providing a second function of the circuit system. And the third sub-circuit is coupled to the second voltage generation circuit and the system power supply voltage generator for proving a third function of the circuit system. A local power supply voltage of the first sub-circuit is the high voltage level and the first voltage level generated by the first voltage generation circuit. A local power supply voltage of the second sub-circuit is the first voltage level generated by the first voltage generation circuit and the second voltage value generated by the second voltage generation circuit. And a local power supply voltage of the third sub-circuit is the second voltage level generated by the second voltage generation circuit and the low voltage level.

These and other objectives of the present invention will no doubt become obvious to those of ordinary skill in the art after reading the following detailed description of the embodiment that is illustrated in the various figures and drawings.

DETAILED DESCRIPTION

Figure 1:
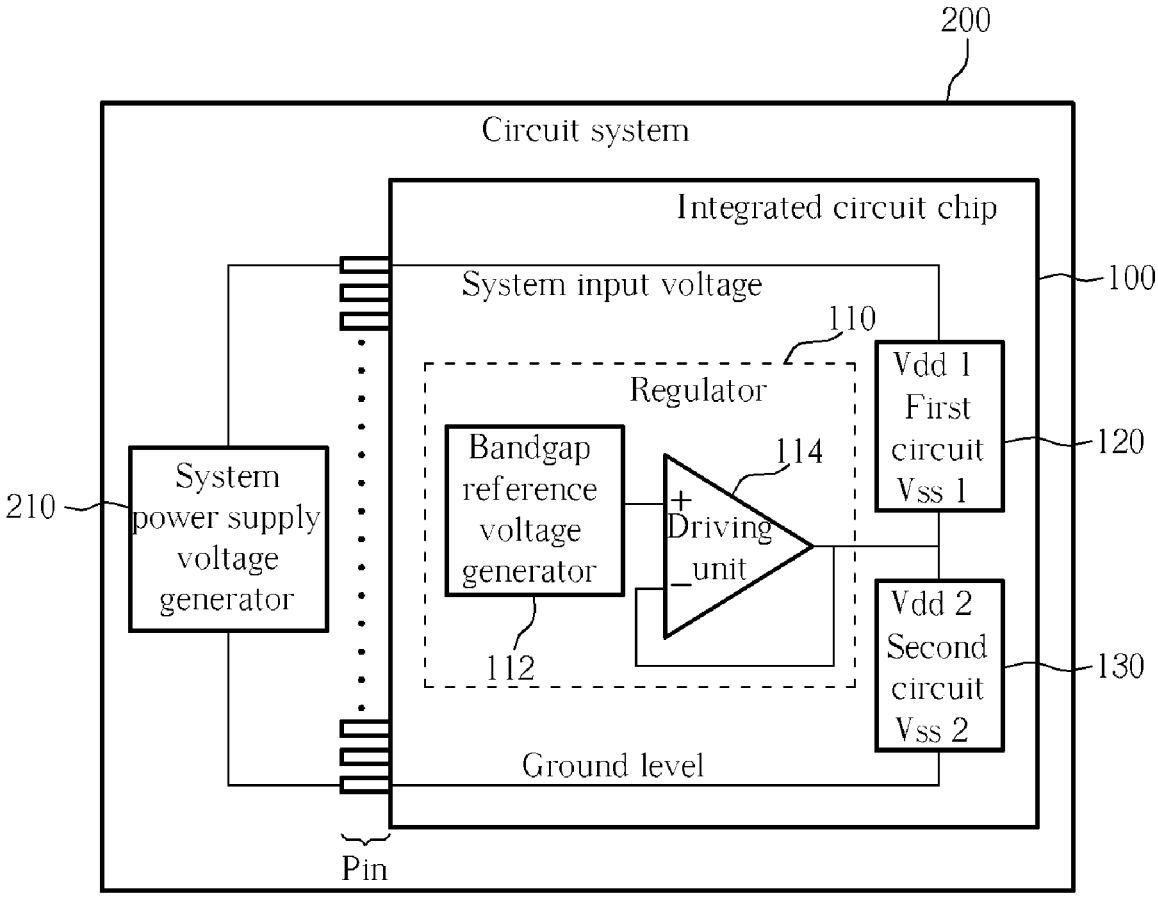
FIG. 1 shows a voltage converting circuit structure according to an embodiment of the present invention.

FIG. 1 shows a voltage converting circuit structure according to an embodiment of the present invention. A circuit system 200, such as a motherboard, includes a system power supply voltage generator 210 and an integrated circuit chip (IC) 100. The system power supply voltage generator 210 provides for every component in the circuit system 200, including IC 100. The power supply voltage is generated between a system input voltage Vdd and a ground level Gnd. The IC 100 includes a first circuit 120 and a second circuit 130 to respectively provide part of the functions of the IC 100. The IC 100 includes a regulator 110 as well, which, in this embodiment, is implemented by a bandgap reference voltage generator 112 together with a driving unit 114 comprised of an operational amplifier in feedback configuration. The bandgap reference voltage generator 112 generates a constant reference voltage Vref. And, a regulation voltage Vreg is generated by the driving unit 114, which, in conjunction with the voltage Vdd input from the system, drives and supplies power to the first circuit 120 and the second circuit 130.

In this embodiment, the mentioned system can be a motherboard of a desktop-type or a laptop-type personal computer, and the mentioned integrated circuit chip can be a network chip, a wireless communication chip, an image processing chip, or any other circuit component with various functions, but not limited to the embodiments shown or described. The present invention can be implemented either in integrated circuit form, or in discrete circuit form, and it can be implemented either in a personal computer system, or in other circuit systems, as would be appreciated by those of ordinary skill in the art.

In 0.15-micron process, for example, the system input voltage Vdd-to-GND is usually 3V and the operation voltage of integrated circuit chip is usually 1.5V. Therefore, Vdd1 and Vss1 of the first circuit 120 are respectively set to 3V and 1.5V, while Vdd2 and Vss2 of the second circuit 130 are respectively set to 1.5V and 0V, meaning that the regulator 110 is designed to output a stable voltage value Vreg=1.5V and the operation voltages (Vdd1-Vss1) of the first circuit 120 and (Vdd2-Vss2) of the second circuit 130 are both 1.5V. The system input voltage 3V thereby is divided by the regulation voltage 1.5V from the regulator 110, into two sets of power supply voltages (Vdd1-Vss1) and (Vdd2-Vss2), both with voltage drop 1.5V, for respectively driving two different parts of IC 100, i.e. the first circuit 120 and the second circuit 130.

In an embodiment of the present invention, the configuration and functions of the first circuit 120 and the second circuit 130 are substantially the same except for insignificant differences. In this circumstance, with the same voltage drop across and the same circuit configuration in the first circuit 120 and the second circuit 130, it is predictable that a total current amount flowing through the first circuit 120 will be close to a total current amount flowing through the second circuit 130. In the following description of the embodiment, by utilizing the mentioned voltage converting circuit structure, power efficiency approaching 100% can be achieved, the current driving capability of the output stage in the driving unit 114 of the regulator 110 is minimized and circuit area is thus minimized, and waste of power is also reduced to a minimum.

Figure 2:
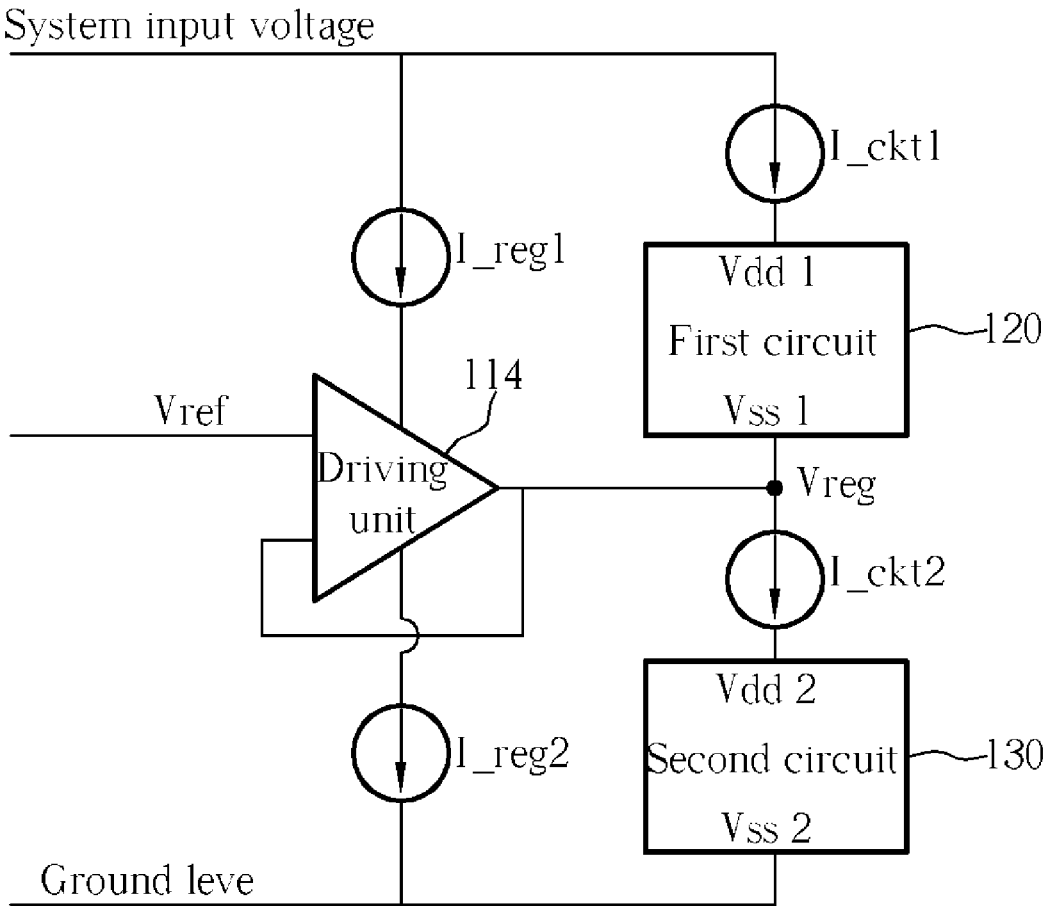
FIG. 2 shows another diagram of the voltage converting circuit structure according to FIG. 1.

Please refer to FIG. 2. FIG. 2 is another diagram of the voltage converting circuit structure according to FIG. 1, which further helps illustrate the power efficiency of this circuit structure. In FIG. 2, a symbol of a current source I_ckt1 represents the total current amount flowing through the first circuit 120, a symbol of a current source I_ckt2 represents the total current amount flowing through the second circuit 130, a symbol of a current source I_reg1 represents a total current amount flowing from Vdd to the output stage in the driving unit 114, and a symbol of a current source I_reg2 represents a total current amount flowing from the output stage in the driving unit 114 to Gnd. Assuming that the system input voltage is Vdd, and the voltage drops of the first circuit 120 and the second circuit 130 are both Vds. When the system enters stability, the following equation is obtained according to Kirchhoff's Current Law:

$$I_ckt1+I_reg1=I_ckt2+I_reg2 \quad \text{Eq(1)}$$

The power provided by the system is Vdd×(I_ckt1+I_reg1), the total power consumption of the first circuit 120 and the second circuit 130 is (I_ckt1+I_ckt2)×Vds. Therefore, the power efficiency is (I_ckt1+I_ckt2)×Vds/[Vdd×(I_ckt1+I_reg1)]. In the mentioned embodiment, since I_ckt1≈I_ckt2, I_reg1 and I_reg2 are much smaller than I_ckt1 and I_ckt2, and thus I_reg1 and I_reg2 can be ignored. As a result, when Vds=Vdd/2, the power efficiency approximates 100%.

Figure 3:
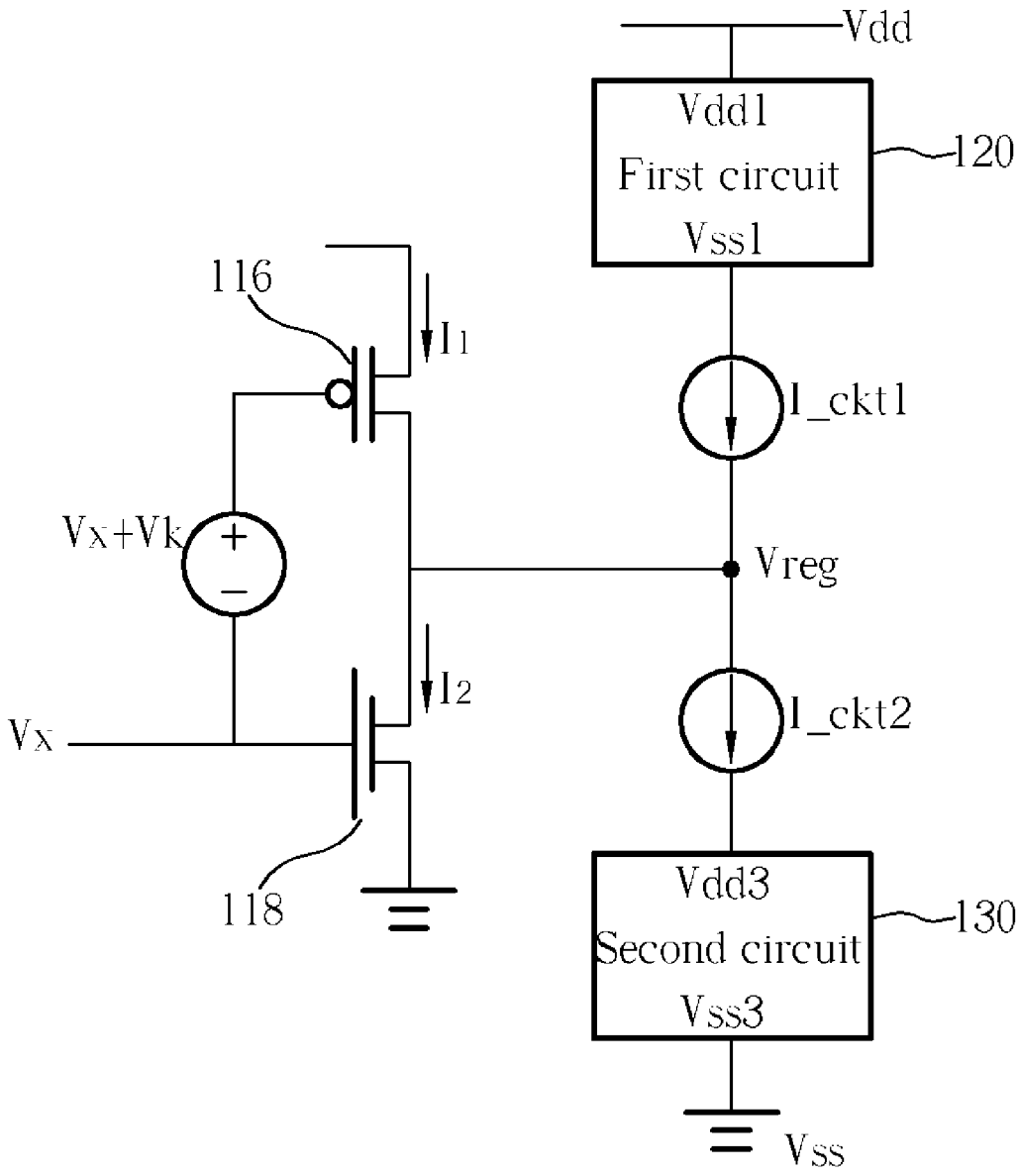
FIG. 3 shows yet another diagram of the voltage converting circuit structure according to FIG. 1.

Please refer to FIG. 3. FIG. 3 shows yet another diagram of the voltage converting circuit structure according to FIG. 1, which helps explain how the output stage in the driving unit 114 minimizes the circuit area in the embodiment. In FIG. 3, a general implement of the output stage in the driving unit 114, for example, is a PMOS transistor 116 coupled to Vdd and a NMOS transistor 118 coupled to the ground Gnd. According to Kirchhoff's Current Law, the following equation is obtained:

$$I_ckt1+I1=I_ckt2+I2 \quad \text{Eq(2)}$$

In the embodiment, the current I_ckt1 flowing through the first circuit 120 is close to the current I_ckt2 flowing through the second circuit 130, and therefore current I1 and I2 that the output stage transistors 116 and 118 bear in the driving unit 114 is limited, area of the components is reduced, and the power consumption is minimized. For example, if I_ckt1 is 10 mA and I_ckt2 is 500 mA, to meet Kirchhoff's Current Law, the PMOS transistor 116 must be designed to bear at least I1=490 mA, and thus the circuit area becomes intolerantly large. However, if I_ckt1 and I_ckt2 are both 500 mA, the PMOS transistor 116 and the NMOS transistor 118 can be designed to bear limited current, and thus circuit area is minimized.

Please note that in some applications, if it is certain that the current flowing through the first circuit 120 is close to the current flowing through the second circuit 130, such as in a application where the first circuit 120 is similar structurally and operationally to the second circuit 130, only a driving unit 114 with small driving capacity is needed. Furthermore, the driving unit 114 can even be omitted; that is, a buffering component is not needed and the reference voltage can be directly coupled between the first circuit 120 and the second circuit 130 without jeopardizing the normal operation of said circuits.

Figure 4:
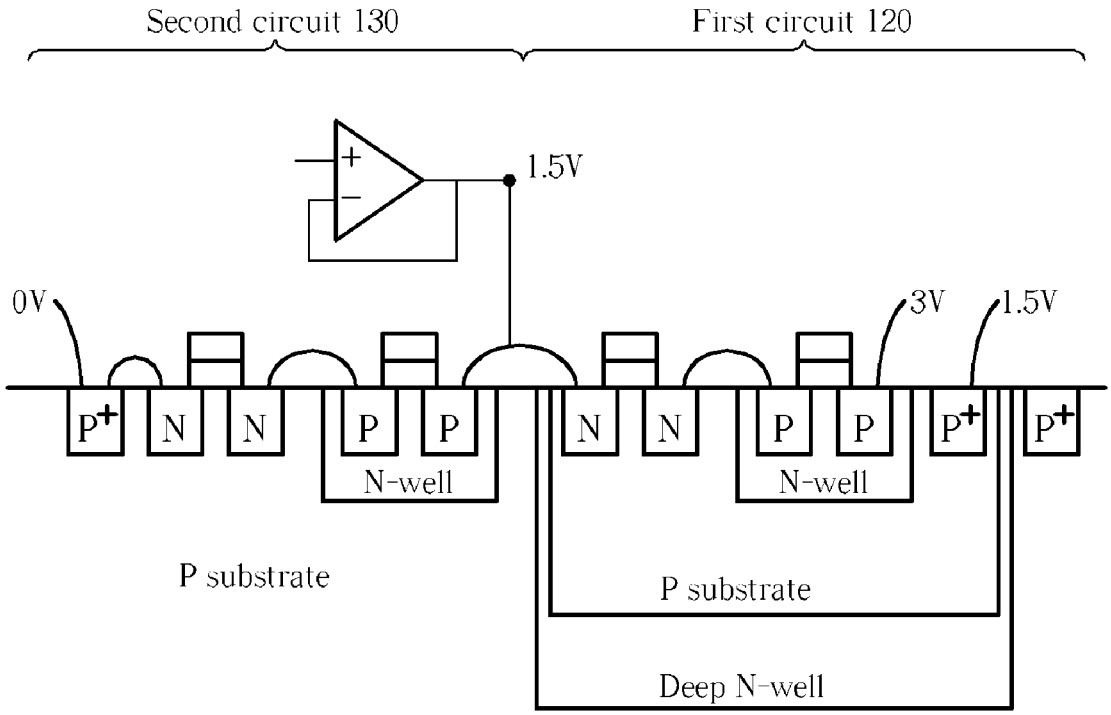
FIG. 4 shows a cross-sectional view of the first circuit and the second circuit of FIG. 1.

Please also note that, because most circuits in IC 100, including the first circuit 120 and the second circuit 130, operate under low supply voltages, such as 1.5V, low-voltage process is normally utilized for manufacturing. However, the circuits so manufactured cannot bear high voltages, such as 3V. To prevent the first circuit 120 coupled to Vdd (3V) from being in the same substrate with the second circuit 130 coupled to Gnd and from being damaged by too high a voltage drop, manufacturing technologies such as deep N-well or the like, can be utilized for circuit protection. Please refer to FIG. 4. FIG. 4 shows a cross-sectional view of to the first circuit and the second circuit. The first circuit 120 is surrounded by deep N-well to ensure that the voltage drop between each electrode pair is acceptable to avoid damages to the first circuit 120.

The regulator 110 described above is implemented with a bandgap reference voltage generator and an operational amplifier, but the scope of the present invention is not limited thereto. Anyone skilled in the art would know that any circuit configuration generating a constant voltage value can be implemented in the present invention. Although the embodiment is that the operation voltage of the first circuit 120 and the operation voltage of the second circuit 130 are equal, the scope of the present invention is not limited thereto. The first circuit 120 with operation voltage different from the second circuit can also implement the present invention. In the embodiment, the first circuit 120 and the second circuit 130 are assumed similar in functions and circuit configurations, but the scope of the present invention is not limited thereto. Although the mentioned regulator is disposed in an integrated circuit chip, the scope of the present invention is not limited thereto, and the regulator can be an off-chip component. The bandgap reference voltage generator 112 can be implemented by utilizing any known or new circuitries serving to provide reference voltages, such as a voltage divider circuit incorporating resistors.

Figure 5:
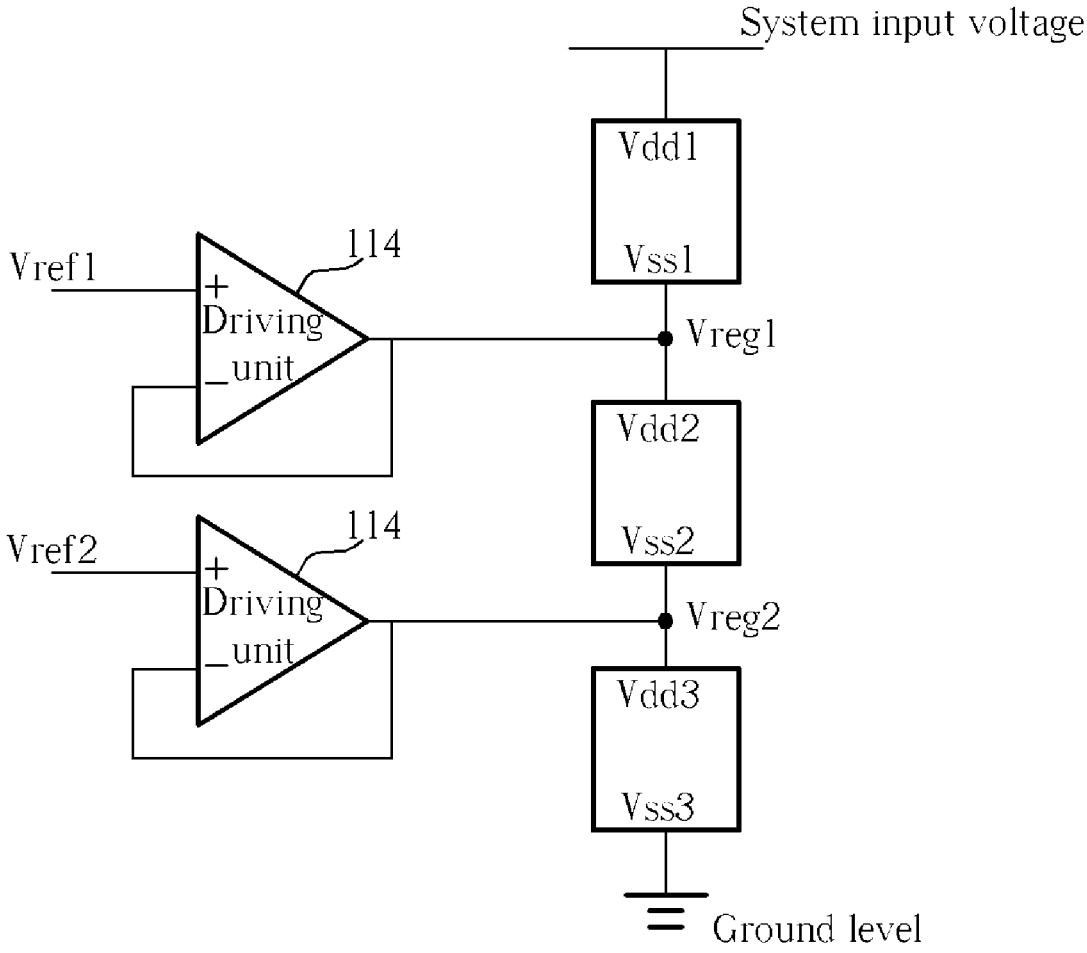
FIG. 5 shows a voltage converting circuit according to another embodiment of the present invention.

In the above-mentioned embodiment, a regulator divides the system input voltage into two sets of lower operation voltage, but anyone skilled in the art would know that the scope of the present invention is not limited thereto. Please refer to FIG. 5. FIG. 5 shows a voltage converting circuit structure according to another embodiment of the present invention. The structure in FIG. 5 utilizes two regulators to divide the system input voltage Vdd into three sets of power supply voltage (Vdd1, Vss1), (Vdd2, Vss2), and (Vdd3, Vss3), to respectively provide three circuits with power. And so forth, N−1 regulators can be utilized to divide Vdd into N sets of power supply voltage to respectively provide N circuits with power.

The above-mentioned voltage converting circuits are suitable for a system including several identical or similar circuits, such as two ports of a multi-port gigabit Ethernet transceiver, or I-channel and Q-channel of radio-frequency system under the circumstance of N=2, and such as R, G, and B channels of image processing system in digital TV under the circumstance of N=3. And the scope of the present invention is not so limited.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A voltage converting circuit comprising:

a first circuit, wherein a first current flows through the first circuit and a first voltage drop spans the first circuit;

a second circuit coupled to the first circuit, wherein a second current flows through the second circuit and a second voltage drop spans the second circuit; and a first driving unit coupled to a connecting point between the first circuit and the second circuit;

wherein the first circuit is isolated from the second circuit by a deep N-well.

2. The voltage converting circuit of claim 1, wherein the first voltage drop to the second voltage drop is a predetermined ratio.

3. The voltage converting circuit of claim 1 wherein the first voltage drop equals the second voltage drop.

4. The voltage converting circuit of claim 1, wherein output power of the first circuit approximates output power of the second circuit.

5. The voltage converting circuit of claim 1, wherein the first driving unit is coupled in feedback to a connecting point between the first circuit and the second circuit.

6. A voltage converting apparatus comprising:

a reference voltage generation unit for generating a reference voltage; and a voltage converting unit comprising a first circuit and a second circuit, wherein the first circuit is coupled to the second circuit, the first circuit is similar to the second circuit, and the reference voltage generation unit is coupled to the voltage converting unit, wherein the first circuit is isolated from the second circuit by a deep N-well.

7. The voltage converting apparatus of claim 6, wherein the reference voltage is coupled between the first circuit and the second circuit.

8. The voltage converting apparatus of claim 6, wherein the first circuit and the second circuit are identical.

9. The voltage converting apparatus of claim 6, wherein the reference voltage generation unit further comprises a driving unit, the driving unit being coupled in feedback to the voltage converting unit.

10. A circuit system comprising:

N sub-circuits for respectively providing for at least part of the functions of the circuit system; and N−1 voltage generation circuits, wherein each voltage generation circuit generates a voltage level respectively;

wherein the N sub-circuits are coupled in cascode between a high voltage level and a low voltage level of a system power supply voltage, a local power supply voltage of a first sub-circuit of the N sub-circuits is composed of the high voltage level of the system power supply voltage and the voltage level generated by a first voltage generation circuit of the N−1 voltage generation circuits, a local power supply voltage of a Nth sub-circuit of the N sub-circuits is composed of the voltage level generated by a (N−1)th voltage generation circuit of the N−1 voltage generation circuits and the low voltage level of the system power supply voltage, and a local power supply voltage of a nth sub-circuit of the rest of the sub-circuits is composed of the voltage level generated by a (n−1)th voltage generation circuit of the N−1 voltage generation circuits and the voltage level generated by a nth voltage generation circuit of the N−1 voltage generation circuits;

and wherein at least one of the sub-circuits is isolated from the other sub-circuit by a deep N-well.

11. The circuit system of claim 10, wherein N=2.

12. The circuit system of claim 11, wherein the voltage level generated by the voltage generation circuit substantially approximates half of a difference between the high voltage level and the low voltage level of the system power supply voltage.

13. The circuit system of claim 12, wherein averagely speaking, a total current amount flowing through the first sub-circuit substantially approximates a total current amount flowing through a second sub-circuit of the N sub-circuits.

14. The circuit system of claim 10 further comprising a system power supply voltage generator for generating the high voltage level and the low voltage level of the system power supply voltages.

15. The voltage converting apparatus of claim 10, wherein the N−1 voltage generation circuits further comprise M driving units, each of the M driving units being coupled in feedback to the connecting points between the sub-circuits, where $M \leqq N-1$.

16. A circuit system comprising:

a first circuit, formed on a first substrate, comprising:

a first pole, surrounded by a first layer; and a second pole;

a second circuit, formed on a second substrate, comprising:

a third pole, surrounded by a second layer; and a fourth pole;

wherein the first substrate is isolated from the second substrate by a third layer.

17. The circuit system of claim 16, wherein a driving unit is coupled to a connecting point between the first circuit and the second circuit.

18. The circuit system of claim 16, wherein the third layer is a deep N-well.

19. The circuit system of claim 16, wherein a first voltage drop spans the first circuit, a second voltage drop spans the second circuit, and the first voltage drop to the second voltage drop is a predetermined ratio.

20. The circuit system of claim 16, wherein the first voltage drop equals the second voltage drop.

* * * * *